US011598232B2

(12) United States Patent
Miyanaga et al.

(10) Patent No.: US 11,598,232 B2
(45) Date of Patent: Mar. 7, 2023

(54) PCV VALVE COUPLING STRUCTURE

(71) Applicants: TOYOTA BOSHOKU KABUSHIKI KAISHA, Aichi-ken (JP); TOYOTA JIDOSHA KABUSHIKI KAISHA, Aichi-ken (JP)

(72) Inventors: Naritsune Miyanaga, Toyota (JP); Yoji Horiuchi, Kariya (JP); Hideto Morishita, Gifu (JP); Masami Ishikawa, Aichi-ken (JP)

(73) Assignees: TOYOTA BOSHOKU KABUSHIKI KAISHA, Aichi-Ken (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 548 days.

(21) Appl. No.: 16/381,605

(22) Filed: Apr. 11, 2019

(65) Prior Publication Data

US 2019/0316500 A1 Oct. 17, 2019

(30) Foreign Application Priority Data

Apr. 17, 2018 (JP) ..... JP2018-079216
Nov. 12, 2018 (JP) ..... JP2018-212108

(51) Int. Cl.
*F01M 13/00* (2006.01)

(52) U.S. Cl.
CPC ..... *F01M 13/0011* (2013.01)

(58) Field of Classification Search
CPC ..... F01M 13/00; F01M 13/0011
See application file for complete search history.

(56) References Cited

U.S. PATENT DOCUMENTS 6,418,918 B2 * 7/2002 Mammarella ..... F01M 13/04 123/573
6,591,796 B1 * 7/2003 Scott ..... F01M 11/02 123/90.55
6,883,538 B2 * 4/2005 Toyokawa ..... F16L 41/088 123/574
7,195,283 B2 * 3/2007 Chisnell ..... F16L 19/02 285/124.1

(Continued)

FOREIGN PATENT DOCUMENTS

DE 60028490 T2 6/2007
JP 2002-195017 7/2002

(Continued)

OTHER PUBLICATIONS

Japanese Office Action in counterpart Japanese Application No. 2018-212108, dated Aug. 18, 2020 (and English translation thereof).

(Continued)

*Primary Examiner* — Kurt Philip Liethen
(74) *Attorney, Agent, or Firm* — Greenblum & Bernstein, P.L.C.

(57) ABSTRACT

A PCV valve coupling structure that couples a PCV valve to an internal combustion engine is employed in the PCV valve used to adjust a gas flow area of a blow-by gas passage. Blow-by gas in the internal combustion engine flows to an intake system of the internal combustion engine. In the PCV valve coupling structure, the PCV valve is coupled to the internal combustion engine in a non-removable manner.

3 Claims, 4 Drawing Sheets

(56) References Cited

U.S. PATENT DOCUMENTS

| | | | | |
|---|---|---|---|---|
| 10,480,366 | B2 * | 11/2019 | Wyatt | F01M 13/04 |
| 2001/0052342 | A1 | 12/2001 | Mammarella | |
| 2002/0112710 | A1 * | 8/2002 | Akiwa | F01M 13/0416 123/572 |
| 2003/0024512 | A1 | 2/2003 | Kitano et al. | |
| 2003/0172632 | A1 | 9/2003 | Matsubara et al. | |
| 2010/0225106 | A1 * | 9/2010 | Newman | F02M 35/116 285/204 |
| 2012/0006306 | A1 | 1/2012 | Boehm et al. | |
| 2014/0174415 | A1 * | 6/2014 | Murakami | F01M 13/0011 123/574 |
| 2015/0226097 | A1 | 8/2015 | Hasegawa | |
| 2015/0292374 | A1 * | 10/2015 | Kira | F01M 13/0416 123/574 |
| 2016/0348614 | A1 * | 12/2016 | Dudar | B60T 13/46 |
| 2018/0051606 | A1 * | 2/2018 | Muramatsu | F01M 13/0011 |
| 2018/0058398 | A1 * | 3/2018 | Newman | F02M 35/1036 |
| 2018/0066572 | A1 * | 3/2018 | Nonaka | F01M 13/00 |
| 2018/0252191 | A1 * | 9/2018 | Pitcel | F02M 37/08 |
| 2019/0017420 | A1 * | 1/2019 | Kashiwabara | F01M 13/04 |

FOREIGN PATENT DOCUMENTS

| | | | |
|---|---|---|---|
| JP | 2003-049625 | | 2/2003 |
| JP | 2003-254031 | A | 9/2003 |
| JP | 2009-150351 | A | 7/2009 |
| JP | 2009-264275 | A | 11/2009 |
| JP | 2011-236854 | | 11/2011 |
| JP | 2015-151864 | A | 8/2015 |

OTHER PUBLICATIONS

Chinese Office Action in counterpart Chinese Patent Application No. CN201910289202.5, dated Jun. 7, 2021 (along with English translation thereof).

German Office Action in counterpart German Application No. 10 2019 109 893.9, dated Mar. 18, 2022 (along with English-language translation thereof).

* cited by examiner

PCV VALVE COUPLING STRUCTURE

BACKGROUND

1. Field

The following description relates to a PCV valve coupling structure.

2. Description of Related Art

The internal combustion engine installed in a vehicle or the like includes a blow-by gas recirculation device that causes blow-by gas in the internal combustion engine to flow back to the intake system. The blow-by gas recirculation device includes a blow-by gas passage through which blow-by gas flows to the intake system of the internal combustion engine and a PCV valve used to adjust the gas flow area of the blow-by gas passage. The PCV valve is arranged halfway on the blow-by gas passage. For example, the PCV valve is coupled to the internal combustion engine as described in Japanese Laid-Open Patent Publication No. 2011-236854. More specifically, the PCV valve is fastened to the internal combustion engine by fastening bolts to limit removal of the PCV valve from the internal combustion engine.

As described in the above-mentioned publication, when the PCV valve is fastened to the internal combustion engine by bolts, the PCV valve does not easily come off from the internal combustion engine. However, a user may remove the PCV valve from the internal combustion engine by unfastening the bolts. In this case, blow-by gas in the internal combustion engine will be emitted into the atmosphere through a portion of the internal combustion engine coupled to the PCV valve.

SUMMARY

It is an objective of the present invention to provide a PCV valve coupling structure that prevents the emission of blow-by gas into the atmosphere caused when the PCV valve is removed from the internal combustion engine.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A first aspect of a PCV valve coupling structure that solves the above-described problem is employed in a PCV valve used to adjust a gas flow area of a blow-by gas passage through which blow-by gas in an internal combustion engine flows to an intake system of the internal combustion engine, the PCV valve coupling structure coupling the PCV valve to the internal combustion engine. In the PCV valve coupling structure, the PCV valve is coupled to the internal combustion engine in a non-removable manner.

A second aspect of a PCV valve coupling structure that solves the above-described problem is employed in a PCV valve used to adjust a gas flow area of a blow-by gas passage through which blow-by gas in an internal combustion engine flows to an intake system of the internal combustion engine, the PCV valve coupling structure coupling the PCV valve to the internal combustion engine. The PCV valve coupling structure includes a coupling member that is separate from the PCV valve and used to couple the PCV valve to the internal combustion engine in a non-removable manner.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A PCV valve coupling structure according to a first embodiment will now be described with reference to FIGS. 1 and 2.

Figure 1:
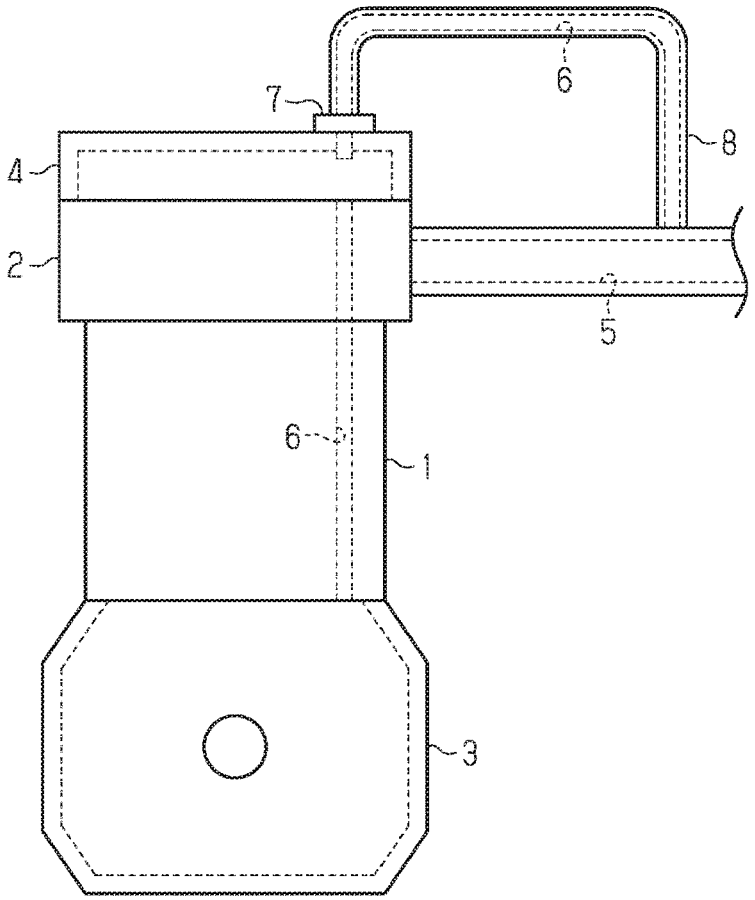
FIG. 1 is a schematic diagram showing the entire internal combustion engine in which a PCV valve coupling structure according to a first embodiment is employed.

As shown in FIG. 1, the internal combustion engine includes a cylinder block 1, a cylinder head 2 coupled to the upper end of the cylinder block 1, a crankcase 3 coupled to the lower end of the cylinder block 1, and a plastic head cover 4 that covers the upper part of the cylinder head 2.

In the internal combustion engine, when fuel is burned in a combustion chamber, blow-by gas leaks from the combustion chamber into the crankcase 3. Thus, the internal combustion engine includes a blow-by gas recirculation device that causes gas (including blow-by gas) in the crankcase 3 to flow back to the intake system (intake passage 5) of the internal combustion engine. The blow-by gas recirculation device includes a blow-by gas passage 6 through which blow-by gas in the crankcase 3 flows to the intake passage 5 and a PCV valve 7 used to adjust the gas flow area of the blow-by gas passage 6.

The PCV valve 7 is coupled to the head cover 4. One end of a hose 8 is connected to the PCV valve 7, and the other end of the hose 8 is connected to the intake passage 5 of the internal combustion engine. The blow-by gas passage 6 communicates with the crankcase 3. The blow-by gas passage 6 extends through the cylinder block 1, the cylinder head 2, the head cover 4, the PCV valve 7, and the hose 8 to communicate with the intake passage 5.

Thus, the PCV valve 7 is arranged halfway on the blow-by gas passage 6. Adjusting the gas flow area of the blow-by gas passage 6 with the PCV valve 7 changes the flow rate of gas flowing from the crankcase 3 through the blow-by gas passage 6 to the intake passage 5.

The structure for coupling the PCV valve 7 to the head cover 4 will now be described.

Figure 2:
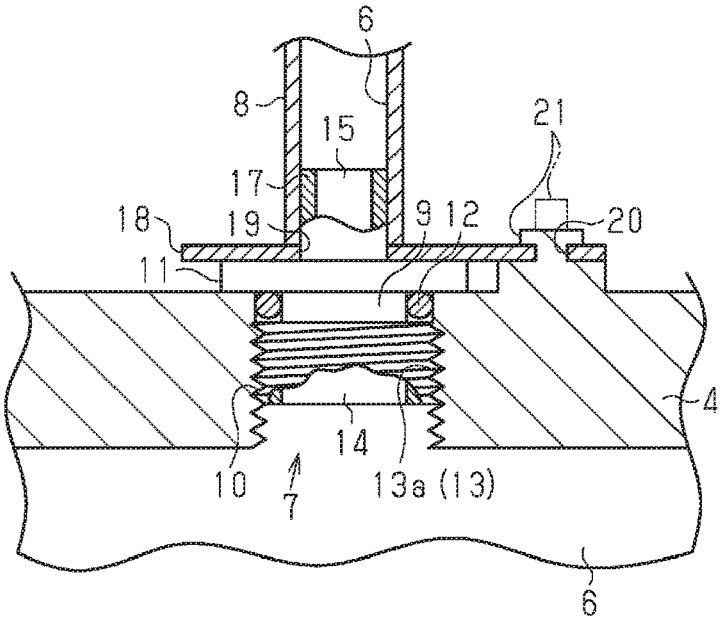
FIG. 2 is a cross-sectional view showing the PCV valve coupling structure according to the first embodiment.

As shown in FIG. 2, the PCV valve 7 includes a tubular housing 9. The outer circumferential surface of the lower end of the housing 9 includes an external thread 10. The outer circumferential surface of the upper end of the housing 9 includes a flange 11. In addition, a seal ring 12 is arranged between the external thread 10 and the flange 11 on the outer circumferential surface of the housing 9.

The head cover 4 includes a coupling hole 13 to which the PCV valve 7 is coupled. The inner circumferential surface of the coupling hole 13 includes an internal thread 13*a* with which the external thread 10 of the housing 9 of the PCV valve 7 is engaged. When the external thread 10 of the housing 9 is engaged with the internal thread 13*a* of the coupling hole 13, the flange 11 of the housing 9 is located on the outer side of the head cover 4 (upper side in FIG. 2) in contact with the head cover 4. Further, the seal ring 12 seals a part between the outer circumferential surface of the housing 9 and the inner circumferential surface of the coupling hole 13.

The end surface of the housing 9 located closer to the external thread 10 (lower end surface in FIG. 2) includes an inflow hole 14 that communicates with the inside of the head cover 4. The end surface of the housing 9 located closer to the flange 11 (upper end surface in FIG. 2) includes a protrusion 17 to which the hose 8 is connected. The protrusion 17 includes an outflow hole 15 that communicates with the inside of the hose 8. Gas in the head cover 4 flows from the inflow hole 14 into the housing 9 and then flows from the inside of the housing 9 through the outflow hole 15 into the hose 8.

A plate-shaped coupling member 18, which is made of plastic or metal, is arranged on the upper side of the flange 11 of the PCV valve 7. The coupling member 18 is separate from the PCV valve 7. The coupling member 18 is used to couple the PCV valve 7 to the head cover 4. The coupling member 18 is in contact with the flange 11 of the PCV valve 7. The coupling member 18 has a through-hole 19. The protrusion 17 of the PCV valve 7 extends vertically through the through-hole 19. Further, a fixation hole 20 is formed beside the through-hole 19 of the coupling member 18. A deformation part 21 protruding upward from the head cover 4 extends through the fixation hole 20. From a state in which the deformation part 21 extends through the fixation hole 20 as shown by the long dashed double-short dashed line in FIG. 2, heat is applied to plastically deform the deformation part 21 such that the diameter of the deformation part 21 increases as shown by the solid line in FIG. 2.

As a result, the PCV valve 7 is coupled to the head cover 4 of the internal combustion engine by the coupling member 18 in a non-removable manner. More specifically, the PCV valve 7 is pressed down toward the coupling hole 13 by the coupling member 18, thereby fixing the PCV valve 7 to the head cover 4 to prevent the removal of the PCV valve 7 from the coupling hole 13. Additionally, after plastic deformation of the deformation part 21 causes the coupling member 18 to be coupled to the head cover 4 as described above, the PCV valve 7 cannot be removed from the head cover 4.

The advantages of the coupling structure for the PCV valve 7 according to the first embodiment will now be described.

(1) The PCV valve 7 is coupled to the head cover 4 of the internal combustion engine by the coupling member 18 in a non-removable manner. This prevents the PCV valve 7 from coming off from the head cover 4 and also prevents a user from removing the PCV valve 7 from the head cover 4. Thus, the removal of the PCV valve 7 from the head cover 4 of the internal combustion engine is prevented. Consequently, the emission of blow-by gas into the atmosphere caused by the removal of the PCV valve 7 is prevented.

(2) To arrange blow-by gas recirculation devices in various types of internal combustion engines, it is desired that the same PCV valve 7 be used to achieve cost reduction. However, the internal combustion engines may have different types of relationships between the coupling hole 13 and the deformation part 21 of the head cover 4. In this case, multiple types of coupling members 18 corresponding to the positional relationships between the coupling hole 13 and the deformation part 21 in the internal combustion engines are prepared. This allows the PCV valve 7 to be coupled to the head cover 4 in a non-removable manner without modifying the PCV valve 7. Thus, the same PCV valve 7 can be used in each internal combustion engine.

Second Embodiment

A PCV valve coupling structure according to a second embodiment will now be described with reference to FIGS. 3 and 4.

In the internal combustion engine in which the PCV valve 7 is employed, a separator configured to separate liquid such as oil from blow-by gas is arranged halfway on the blow-by gas passage 6. The PCV valve 7 according to the second embodiment is used to adjust the gas flow area of a portion of the blow-by gas passage 6 corresponding to the separator.

Figure 3:
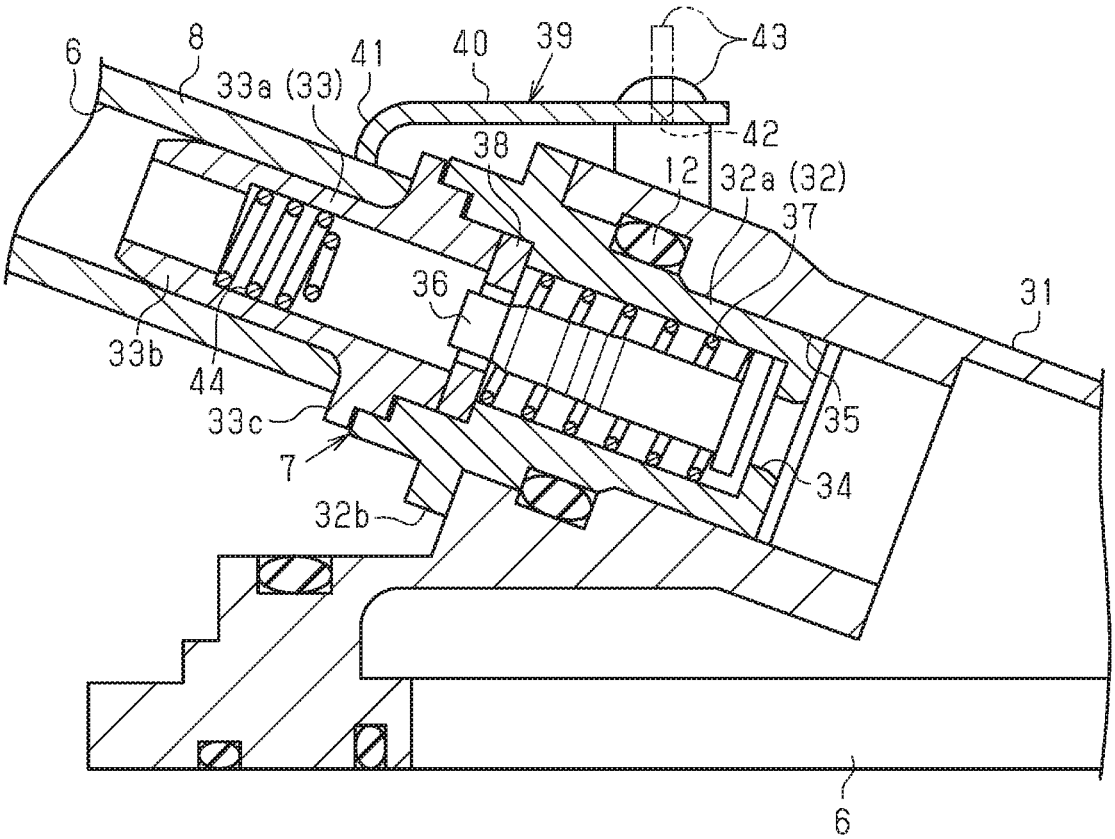
FIG. 3 is a cross-sectional view showing a PCV valve coupling structure according to a second embodiment.

As shown in FIG. 3, the PCV valve 7 is inclined with respect to the horizontal plane and coupled to a plastic separator 31. The PCV valve 7 includes a flow rate adjustment unit 32 configured to adjust the gas flow area of the blow-by gas passage 6 and a pipe connection unit 33 configured to connect the hose 8 to the flow rate adjustment unit 32. Blow-by gas in the internal combustion engine is separated from liquid such as oil in the separator 31 and then flows to the hose 8 through the PCV valve 7 (flow rate adjustment unit 32 and pipe connection unit 33). Thus, the blow-by gas passage 6, through which the blow-by gas flows, extends through the separator 31, the PCV valve 7, and the hose 8.

The flow rate adjustment unit 32 of the PCV valve 7 includes a tubular housing 32*a*. The housing 32*a* is inserted into a coupling hole 35 formed in the separator 31. A communication hole 34 is formed in the end of the housing 32*a* on the opposite side from the end of the housing 32*a* located closer to the pipe connection unit 33. The communication hole 34 communicates with the inside of the separator 31. In addition, the outer circumferential surface of the housing 32*a* includes a flange 32*b*. The flange 32*b* has a larger diameter than the coupling hole 35 of the separator 31 and is in contact with a portion of the outer surface of the separator 31 located around the opening of the coupling hole 35. Additionally, the seal ring 12 is arranged at a portion corresponding to the outer circumferential surface of the housing 32*a* and the inner circumferential surface of the coupling hole 35. The seal ring 12 is in contact with the outer circumferential surface of the housing 32*a* and the inner circumferential surface of the coupling hole 35 to seal a part between the outer circumferential surface of the housing 32*a* and the inner circumferential surface of the coupling hole 35.

The housing 32*a* incorporates a tubular movable member 36, a spring 37, and a ring 38. The movable member 36 extends on the same axis as the housing 32*a*. The spring 37 biases the movable member 36 toward the communication hole 34. The ring 38 is fitted to the inner circumferential surface of the opening of the housing 32*a* located closer to the pipe connection unit 33. In addition, the pipe connection unit 33 includes a tubular housing 33*a*. The housing 33*a* is fitted to the opening of the housing 32*a* of the flow rate adjustment unit 32 located closer to the pipe connection unit 33. As a result, the ring 38 is held between the housing 33*a* of the pipe connection unit 33 and the housing 32*a* of the flow rate adjustment unit 32. The inside of the housing 33*a* communicates with the inside of the housing 32*a* of the flow rate adjustment unit 32 through the ring 38. Further, a flange 33*c* is formed at the end of the housing 33*a* of the pipe connection unit 33 located closer to the flow rate adjustment unit 32. A protrusion 33*b* is formed at the end of the housing 33*a* located on the opposite side from the flange 33*c*. The hose 8 is fitted to the outer circumferential surface of the protrusion 33*b*.

The movable member 36 in the housing 32*a* of the flow rate adjustment unit 32 is biased by a biasing force of the spring 37 to a position where the communication hole 34 of the housing 32*a* is closed. Further, the end of the movable member 36 located closer to the pipe connection unit 33 is inserted into the ring 38. The outer circumferential surface of the movable member 36 has a diameter that is smaller than the inner circumferential surface of the ring 38 and increases toward the communication hole 34. Intake negative pressure of the internal combustion engine acts in the hose 8 and the housing 33*a* of the pipe connection unit 33. Thus, the intake negative pressure causes the movable member 36 to move toward the pipe connection unit 33 against the biasing force of the spring 37. The movement of the movable member 36 toward the pipe connection unit 33 opens the communication hole 34 of the housing 32*a*, which has been closed by the movable member 36. When the communication hole 34 opens, blow-by gas in the separator 31 of the internal combustion engine flows to the hose 8 through the PCV valve 7 (flow rate adjustment unit 32 and pipe connection unit 33).

The flow rate of the blow-by gas varies depending on the position of the movable member 36 relative to the ring 38. That is, during a low-load operation of the internal combustion engine, the movable member 36 is moved toward the pipe connection unit 33 to the largest extent. The large-diameter portion of the outer circumferential surface of the movable member 36 is opposed to the inner circumferential surface of the ring 38. This reduces the gas flow area between the outer circumferential surface of the movable member 36 and the inner circumferential surface of the ring 38 and consequently reduces the flow rate of blow-by gas that passes through the PCV valve 7. As the engine load becomes higher, the movable member 36 moves to a smaller extent against the biasing force of the spring 27 toward the pipe connection unit 33. As a result, as the engine load becomes higher, the gas flow area between the outer circumferential surface of the movable member 36 and the inner circumferential surface of the ring 38 increases. This consequently increases the flow rate of blow-by gas that passes through the PCV valve 7. A spring 44 is arranged in the housing 33*a* of the pipe connection unit 33 to restrict excessive movement of the movable member 36 toward the pipe connection unit 33.

The structure for coupling the PCV valve 7 to the separator 31 will now be described.

Figure 4:
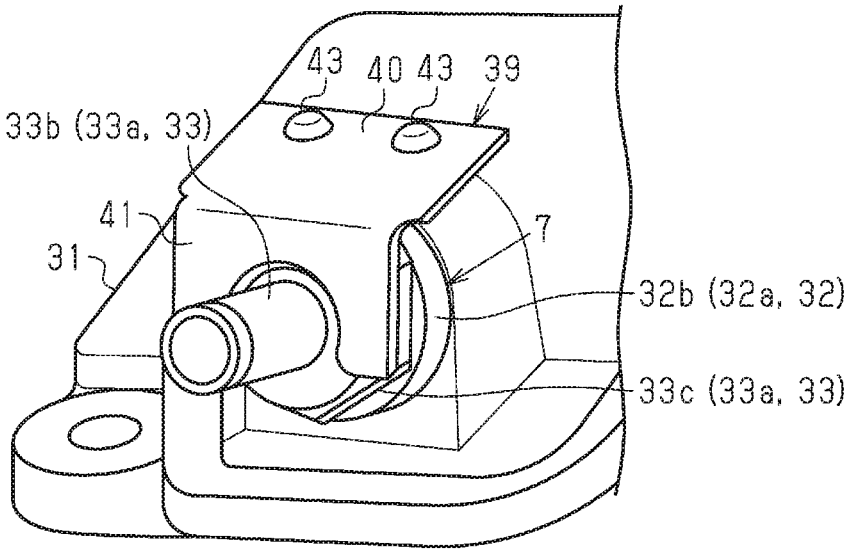
FIG. 4 is a perspective view showing the PCV valve coupling structure according to the second embodiment.

As shown in FIGS. 3 and 4, the PCV valve 7 is coupled to the separator 31 by using a plate-shaped coupling member 39 made of metal. The coupling member 39 has the shape of a plate bent by approximately 90°. Further, the coupling member 39 includes a fixed part 40 and a contact part 41 extending downward from the fixed part 40. The fixed part 40 is fixed to the separator 31 and extends substantially horizontally on the upper side of the PCV valve 7. The contact part 41 is in contact with the flange 33*c* of the housing 33*a* of the pipe connection unit 33 in the PCV valve 7. As a result, the entire flow rate adjustment unit 32 is held between the contact part 41 and the separator 31.

The contact part 41 of the coupling member 39 is in contact with the flange 33*c* of the housing 33*a* of the pipe connection unit 33 while holding the protrusion 33*b* of the pipe connection unit 33 in the PCV valve 7 from the opposite sides of the protrusion 33*b* in the radial direction of the protrusion 33*b*. As shown in FIG. 3, the fixed part 40 of the coupling member 39 includes fixation holes 42. Plastic deformation parts 43 protruding upward from the separator 31 respectively extend through the fixation holes 42. From a state in which the deformation parts 43 extend through the fixation holes 42 as shown by the long dashed double-short dashed line in FIG. 3, heat is applied to plastically deform the deformation parts 43 such that the diameters of the deformation parts 43 increase as shown by the solid line in FIG. 3. As a result, at least the flow rate adjustment unit 32 of the PCV valve 7, more specifically, the pipe connection unit 33 and the flow rate adjustment unit 32, are coupled to the separator 31 of the internal combustion engine by the coupling member 39 in a non-removable manner.

The advantages of the coupling structure for the PCV valve 7 according to the second embodiment will now be described. The second embodiment has the following advantages in addition to advantages (1) and (2) of the first embodiment.

(3) When external impact or the like is applied to cause the part (hose 8) of the blow-by gas passage 6 connecting the intake passage 5 and the PCV valve 7 in the internal combustion engine to be removed from the PCV valve 7 and exposed to the atmosphere, the atmospheric air is drawn into the internal combustion engine through the hose 8. Thus, the intake air amount of the internal combustion engine suddenly increases, thereby stalling the internal combustion engine. When the internal combustion engine is stalled, removal of the hose 8 from the PCV valve 7 can be detected. However, if external impact or the like causes the flow rate adjustment unit 32 to be removed from the internal combustion engine (separator 31) while the hose 8 remains connected to the flow rate adjustment unit 32 through the pipe connection unit 33 of the PCV valve 7, the flow rate adjustment unit 32 limits increases in the intake amount of the atmospheric air that occur when the atmospheric air is drawn into the internal combustion engine through the hose 8. Thus, the intake air amount of the internal combustion engine no longer increases suddenly. This makes it difficult to detect the removal of the hose 8 and the flow rate adjustment unit 32 from the separator 31 by utilizing the stalling of the internal combustion engine, which results from the sudden increases in the intake air amount. In the second embodiment, the removal of the flow rate adjustment unit 32 of the PCV valve 7 from the separator 31 while remaining connected to the hose 8, which results from the application of external impact or the like, is restricted by the coupling member 39. This prevents the occurrence of the above-described problem that detecting the removal of the hose 8 from the separator 31 becomes difficult.

(4) When external impact or the like is applied to cause the part (hose 8) of the blow-by gas passage 6 connecting the intake passage 5 and the PCV valve 7 in the internal combustion engine to be removed from the PCV valve 7 and exposed to the atmosphere, the inner part of the housing 33*a* of the pipe connection unit 33 in the PCV valve 7 is also exposed to the atmosphere. The biasing force of the spring 37 keeps the movable member 36 at a position where the communication hole 34 is closed. This prevents the emission of blow-by gas from the separator 31 of the internal combustion engine into the atmosphere through the PCV valve 7.

Third Embodiment

A PCV valve coupling structure according to a third embodiment will now be described with reference to FIGS. 5 and 6.

Figure 5:
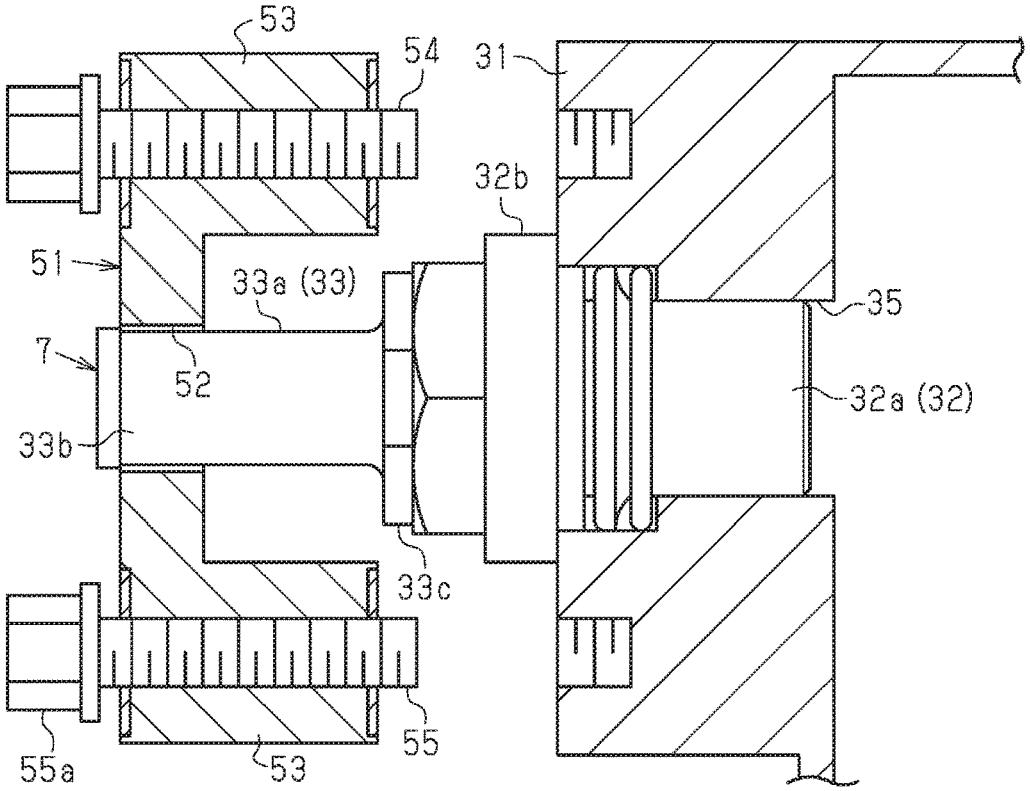
FIG. 5 is a cross-sectional view showing a PCV valve coupling structure according to a third embodiment.
Figure 6:
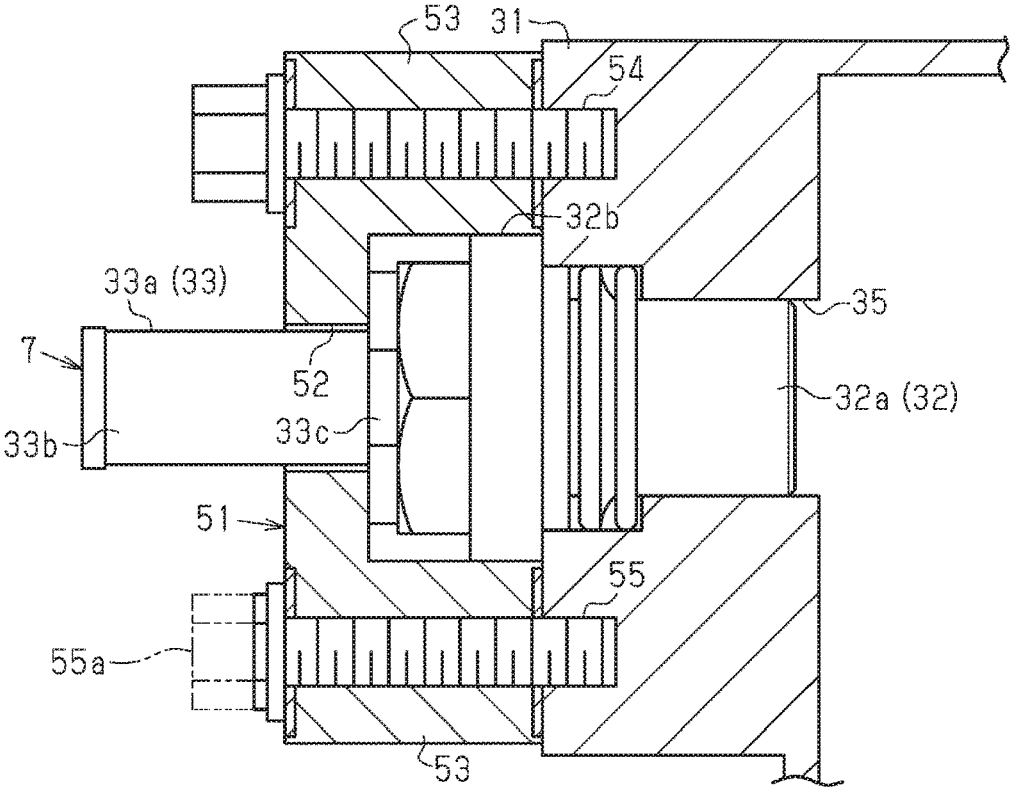
FIG. 6 is a cross-sectional view showing the PCV valve coupling structure according to the third embodiment.

As shown in FIGS. 5 and 6, the PCV valve 7 is coupled to the separator 31 using a metal coupling member 51. In the PCV valve 7, the housing 32*a* of the flow rate adjustment unit 32 is inserted into the coupling hole 35 of the separator 31. Further, the flange 32*b* of the housing 32*a* is in contact with the portion of the outer surface of the separator 31 located around the opening of the coupling hole 35.

The coupling member 51 has a through-hole 52 and multiple (two in the third embodiment) legs 53 protruding toward the separator 31. The protrusion 33*b* of the housing 33*a* of the pipe connection unit 33 in the PCV valve 7 extends through the through-hole 52. As shown in FIG. 5, bolts 54 and 55 respectively extend through portions of the coupling member 51 that correspond to the legs 53. The coupling member 51 is fixed to the separator 31 by fastening the bolts 54 and 55 to the separator 31.

As shown in FIG. 6, when the coupling member 51 is fixed to the separator 31, the distal ends of the legs 53 in a protrusion direction are in contact with the separator 31. Further, the portion of the coupling member 51 located around the through-hole 52 is in contact with the flange 33*c* of the housing 33*a* of the pipe connection unit 33. As a result, the entire flow rate adjustment unit 32 of the PCV valve 7 is held between the coupling member 51 and the separator 31.

A shear bolt is used for one of the bolt 54 and the bolt 55, more specifically, the bolt 55. Fastening the bolt 55 to the separator 31 causes the head 55*a* to break away so that the bolt 55 cannot be removed. When the coupling member 51 is coupled to the separator 31 using the bolt 55, the coupling member 51 allows at least the flow rate adjustment unit 32 of the PCV valve 7, more specifically, the pipe connection unit 33 and the flow rate adjustment unit 32, to be coupled to the separator 31 of the internal combustion engine in a non-removable manner.

Accordingly, the third embodiment has the same advantages as the second embodiment.

Modifications

Each of the above-described embodiments may be modified as described below.

Figure 7:
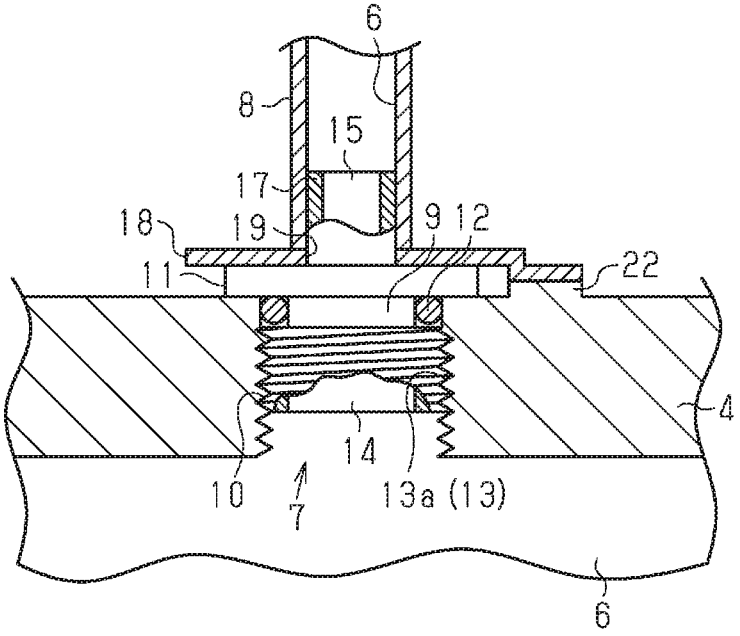
FIG. 7 is a cross-sectional view showing a PCV valve coupling structure according to a modification of the first embodiment.

In the first embodiment, as shown in FIG. 7, a welded portion 22 may be formed in the head cover 4 so that a portion of the coupling member 18 corresponding to the welded portion 22 is welded to the welded portion 22. In this case, when the coupling member 18 is welded to the welded portion 22, the PCV valve 7 is coupled to the head cover 4 by the coupling member 18 in a non-removable manner. In this case, the coupling member 18 is made of plastic.

Figure 8:
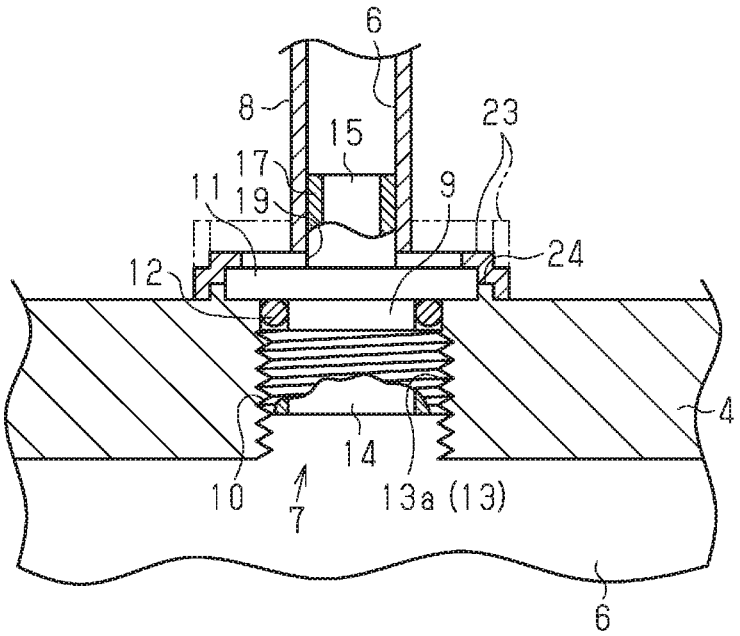
FIG. 8 is a cross-sectional view showing a PCV valve coupling structure according to another modification of the first embodiment.

In the first embodiment, as shown in FIG. 8, a thermal shrinkage tube 23 may be used to couple the PCV valve 7 to the head cover 4. In this case, an annular protrusion 24 that surrounds the outer circumference of the flange 11 of the PCV valve 7 is formed around the opening of the coupling hole 13 of the head cover 4. As shown by the long dashed double-short dashed line in FIG. 8, the thermal shrinkage tube 23, which is tubular before thermal shrinkage, is arranged around the outer circumference of the annular protrusion 24. Subsequently, heat is applied to the thermal shrinkage tube 23 to shrink the thermal shrinkage tube 23 as shown by the solid line in FIG. 8. As a result, the PCV valve 7 is coupled to the head cover 4 by the thermal shrinkage tube 23 in a non-removable manner. In this case, the thermal shrinkage tube 23 serves as a coupling member used to couple the PCV valve 7 to the internal combustion engine in a non-removable manner.

In the first to third embodiments, the coupling members 18, 39, and 51 do not necessarily have to be made of metal. Instead, for example, the coupling members 18, 39, and 51 may be made of other materials such as plastic. In this case, the coupling members 18, 39, and 51 may be coupled to the plastic head cover 4 and the plastic separator 31 in a non-removable manner through various types of welding such as vibration welding, ultrasonic welding, hot-plate welding, and laser welding.

In the first to third embodiments, the head cover 4 and the separator 31 do not necessarily have to be made of plastic. Instead, for example, the head cover 4 and the separator 31 may be made of metal. In this case, the coupling members 18 and 39 are coupled to the metal head cover 4 and the metal separator 31 in a non-removable manner by, for example, using rivets or performing welding. Further, when the coupling members 18, 39, and 51 are made of plastic, the plastic coupling members 18, 39, and 51 may be coupled to the head cover 4 and the separator 31 in a non-removable manner through, for example, thermal deformation.

In the first to third embodiments, the PCV valve 7 does not necessarily have to be coupled to the head cover 4 or the separator 31. Instead, the PCV valve 7 may be coupled to the cylinder head 2. Alternatively, the PCV valve 7 may be coupled to the cylinder block 1.

In the first to third embodiments, the PCV valve 7 may be coupled to the head cover 4 and the separator 31 in a non-removable manner without using the coupling members 18, 39, and 51. For example, the protrusion amounts of the flanges 11 and 32*b* may be set to be large so that the flanges 11 and 32*b* are directly coupled to the head cover 4 and the separator 31 in a non-removable manner.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A PCV valve coupling structure employed in a PCV valve used to adjust a gas flow area of a blow-by gas passage through which blow-by gas in an internal combustion engine flows to an intake system of the internal combustion engine, the PCV valve coupling structure coupling the PCV valve to the internal combustion engine, the PCV valve coupling structure comprising a plate-shaped coupling member that is separate from the PCV valve and used to couple the PCV valve to the internal combustion engine in a non-removable manner, wherein the plate-shaped coupling member includes a fixation hole, and the plate-shaped coupling member is attached to the internal combustion engine by a plastically deformed deformation part protruding from the internal combustion engine and extending through the fixation hole so that the plate-shaped coupling member couples the PCV valve to the internal combustion engine in the non-removable manner.

2. The PCV valve coupling structure according to claim 1, wherein the PCV valve includes a protrusion configured to be connected to a hose, the protrusion includes a hole configured to communicate with an inside of the hose, the plate-shaped coupling member includes a through-hole, and the plate-shaped coupling member is used to couple the PCV valve to the internal combustion engine in the non-removable manner with the protrusion of the PCV valve extending through the through-hole.

3. The PCV valve coupling structure according to claim 1, wherein the PCV valve includes a flow rate adjustment unit configured to adjust the gas flow area of the blow-by gas passage, and the plate-shaped coupling member is used to couple the flow rate adjustment unit to the internal combustion engine in a non-removable manner.

* * * * *